United States Patent [19]

Schaumann et al.

[11] 4,090,053

[45] May 16, 1978

[54] SPRING CONTACT SWITCH ASSEMBLY

[76] Inventors: Anton Schaumann, Reuteberg 81; Willi Weber, Borisriedstrasse 10, both of 7701 Volkertshausen, Germany

[21] Appl. No.: 616,772

[22] Filed: Sep. 25, 1975

[30] Foreign Application Priority Data

Oct. 30, 1974 Germany ..... 2451611

[51] Int. Cl.[2] ..... H01H 1/14

[52] U.S. Cl. ..... 200/241; 200/1 A; 200/247; 200/275

[58] Field of Search ..... 200/1 R, 1 A, 1 TK, 200/6 R, 6 B, 6 C, 159 R, 159 A, 160, 241-251, 267, 275, 276, 283, 308, 315, 339

[56] References Cited

U.S. PATENT DOCUMENTS

| | | | |
|---|---|---|---|
| 1,569,864 | 1/1926 | Leppert | 200/309 X |
| 2,548,103 | 4/1951 | French | 200/247 |
| 2,577,468 | 12/1951 | Knos | 200/275 X |
| 2,816,181 | 12/1957 | Mann et al. | 200/276 X |
| 2,847,522 | 8/1958 | Bernard, Jr. | 200/1 A X |
| 3,133,177 | 5/1964 | Alexandersson | 200/248 X |
| 3,564,180 | 2/1971 | Lyvang | 200/275 X |
| 3,618,409 | 11/1971 | Shifley | 200/339 X |
| 3,619,531 | 11/1971 | Murakami | 200/275 X |
| 3,626,131 | 12/1971 | Barney et al. | 200/159 A |
| 3,773,996 | 11/1973 | Sharf | 200/276 X |
| 3,809,839 | 5/1974 | Beddoe | 200/276 X |
| 3,835,276 | 9/1974 | Field | 200/160 |

*Primary Examiner*—James R. Scott
*Attorney, Agent, or Firm*—Charles E. Baxley

[57] ABSTRACT

A switch has two wire like spring contacts which are cantilever mounted to act as return springs for a pivotable actuator which is urged against the springs when contact is to be made.

7 Claims, 3 Drawing Figures

SPRING CONTACT SWITCH ASSEMBLY

FIELD OF THE INVENTION

The invention relates to an improvement in spring contacts formed from two contact springs clamped on one side elastically and an operating element for the switching of low-tension current. The use of the contact element is carried out preferably in conjunction with printed circuits.

BACKGROUND OF THE INVENTION

Known switch elements, for example micro-switches, for use in printed circuits have the drawback that they require a relatively large amount of space. This is, among other things, due to the housing of the switch which is necessary as a protection against environmental influences as well as for the anchoring of the contact elements and of the resetting element. Such a switch then represents a unit closed on itself and inserted on the printed circuit only with the aid of connecting lugs. The switch described is thus expensive to manufacture.

SUMMARY OF THE INVENTION

The object of the present invention is to provide a cheap but secure switch for use with printed circuits. This switch is built directly onto the printed circuits, without a housing with the advantage that switches can be placed close to one another and thus a high degree of utilization can be achieved.

The contact is designed to be self-cleaning which with closed switches is achieved only with higher mechanical expenditure, than with the switch of the present invention. Furthermore, the present spring contact has no additional resetting element, for example, in the form of an resilient spring as in microswitches.

The problem faced by the invention is solved according to the invention by a spring contact formed from two resilient contact springs clamped on one side and an operating element. In the following, the contact associated with the operating element is designated as a return spring while the second contact arranged in the contact area from the first is designated as a contact spring. Both elements are round wires which are pushed perpendicularly through the bore of a plate and soldered on the back with suitable lead tracks.

The round wires may consist of gilded spring bronze or similar material (for example, gilded, copperplated, steel wire). The spring characteristic of the contacts is given by the one-sided fixing on the plate, by the geometrical dimensions and by the material properties of the round wire. The free end of the contact spring is bent at an angle and forms, with the bent end, the contact face for the opposite return spring. The return spring lies on an operating element, (for example, a key or slide); upon actuation of, for-example a key which presses the return spring against the contact spring and overcomes the spring force of the return spring, until contact with the bent end of the contact spring is made. Upon releasing the manual pressure on the key, the return spring acts to reset the key to its neutral position. The key can thus be rotatably mounted for reducing the operating force. In this case one end of the key (in the form of a lever arm) acts on the return spring, while the other lever arm takes the operating pressure.

The end of the key engaging the return spring is disposed in a cutout portion in a control rail. One end of the control rail limits the resetting position of the key under the action of the return spring in order to avoid clearance. The other end of the control rail limits the working pull of the key such that after contacting the contact spring, both springs can be pressed together with contact on the control rail. Thus contact closing is achieved in which the user is still aware of an additional resilient resistance in this area during the actuation of the key. In order to reinforce this effect the return spring diameter, for example, 0.6mm is made smaller than the contact spring diameter, for example, 0.7mm.

The advantage of this arrangement is the mechanical simplicity which is expressed in the low manufacturing and assembly costs. The insertion of the straight and bent spring element (return and contact springs) is effected during the assembly of the plate. An adjustment is only necessary in so far as it must be ensured that the return spring in the contact area contacts the contact spring also in the direction of the contact. The contact spring may also be bent with its end bent at an angle in the direction of the return spring; for example, at an angle of 60° to the contact path. This has two advantageous effects. The spring contact according to the invention is thereby self cleaning in two directions. On the one hand, the return spring slides during the contact closing in the direction of the contact path vertically on the angle member of the contact spring; and on the other hand, the return spring, due to the production of the end bent at an angle to the contact, path slides horizontally on the bent part of the return spring. In this way a fixed constant point of contact of the contacts is avoided.

As the springs can be closely disposed on the conductor plate, a high degree of utilization is obtained which is limited only by the geometrical dimensions of the operating element. The pivotally mounted key and the control rail are mounted above the conductor plate with spacer bolts. This type of fixing is particularly advantageous with key sets as the whole key set can be removed when the equipment side of the conductor plate has to be accessible for repair purposes.

The invention, however, is not to be limited to the above described constructional solution. Instead of round wires, two plate springs lying opposite one another may be used. Similarly, the contact represented as a slide may also be designed as an opener or exchanger. The spring contacts also need not be remote in the contact area on the plate, a suitable bending of the spring elements also permits other mounting positions.

BRIEF DESCRIPTION OF THE DRAWINGS

One embodiment of the invention will be explained with reference to the drawings. Further features and advantages of the invention follow from the drawings and its description.

DETAILED DESCRIPTION

Figure 2:
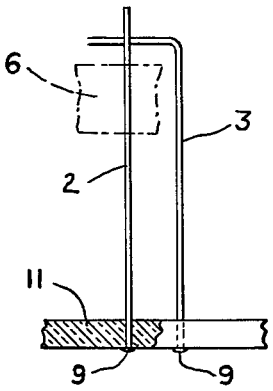
FIG. 2 is a view in the direction of the contact path, the operating element, being omitted.
Figure 3:
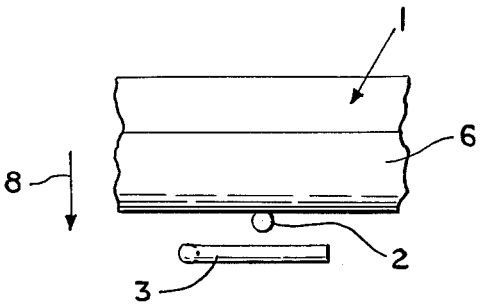
FIG. 3 is an end view of the spring contact.

On a circuit board 11 is soldered a straight round wire, a return spring 2 and a round wire or contact spring 3 having an end bent at right angles. The return spring 2 serves both for contacting and returning operations in that by actuating the key 1 the sliding member 6 presses the return spring 2 against the bent end of the contact spring 3. The key 1 is thus rotated about the pivot 4. The path of the sliding member 6 is limited in the neutral position by the upper wall or leg and in the working position by the lower wall or leg of a control rail 7, the walls being formed in a cutout portion of the rail. In addition, an inclination of the rectangular arrangement of the bent part at the end of contact spring 3 (see FIG. 3) in the direction of movement 8 (contact direction of movement) is possible. The return spring 2 projects beyond the contact spring 3 (see FIG. 2) so that during the contact closing a sliding in the direction of the contact path is possible. The contact spring 3 lies in front of the lower end of the control rail so that both contacts are moved during contact closing while concurrently the sliding member 6 moves on the control rail 7.

the key 1 has on the operating side a frame 12 for receiving a sign plate and an arm 5 on the sliding member 6 for preventing the sign plate from falling into the key mechanism. Furthermore, this member 6 covers and protects the electrical contacts from soiling by dust or like media.

Figure 1:
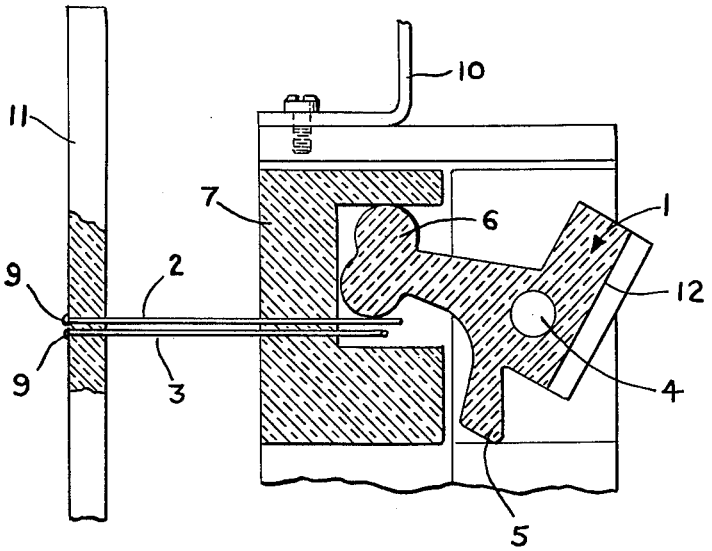
FIG. 1 is a side view partly in section of the spring contact.

The mechanical part of the key consisting of the key 1, the control rail 7 and the pivot pin 4 is fixed on the casing by an angle member 10 at the correct height above the spring contacts (see FIG. 1). The other ends 9 of springs 2 and 3 are terminals for connection to circuits on board 11.

The construction shown represents an advantageous design of the present invention. The advantage compared with the prior art is to be seen in that the contact is mechanically simple and a resetting element and a housing may be dispensed with. As the contact wires can also be bent, the mounting on the conductor plate does not need to be effected in the contact area; on the other hand other conductor path areas may be provided. Thus, an economic conductor path guide with satisfactory solderability of the gilded spring bronze wires is possible. With low actuating force only a short angle of rotation of the key to effect contact closure is necessary.

We claim:

1. A keyswitch comprising a circuit board 11, first and second elongated contact members (2, 3) cantilever mounted in said circuit board, said members being parallel to and spaced from each other, the free end of one of said members being transversely bent, at least one of said members being resilient, a control rail (7) provided with an opening through which extend said contact members, said control rail being cut out to provide a recessed region in which terminate the free ends of said contact members, a key button (1), means for pivotably mounting said key button adjacent said control rail, and said key button having a profiled actuating end (6) extending within said recessed region and resting against the resilient contact member while the other contact member rests against a wall of the cutout portion of said control rail whereby when said key button is depressed the profiled actuating end thereof wipingly urges said resilient contact member against said other contact member.

2. A spring contact according to claim 1, characterized further in that said one contact member (2) is of smaller diameter than said other contact member (3).

3. A spring contact according to claim 1, characterized further in that said contact members (2, 3) consist of gilded spring bronzewire.

4. A spring contact according to claim 3, characterized further in that said resilient contact member (2) is longer than and extends beyond the other said contact member (3).

5. A contact spring according to claim 4, characterized further in that said contact members (2, 3) are fixed in said circuit board by solderings (9) in the direction of the contact path (8) and spaced apart thereon and that said one contact member (3) is bent at right angles to said other contact member (2) part way along its length.

6. A contact spring according to claim 1, characterized further in that a sign plate (12) is mounted on said key button (1).

7. A spring contact according to claim 6, characterized further in that the movement of said key button (1) is limited by the abutting of said actuating end (6) between two walls of the cutout portion of said control rail (7).

* * * * *